US007106265B2

(12) United States Patent
Robertson et al.

(10) Patent No.: US 7,106,265 B2
(45) Date of Patent: Sep. 12, 2006

(54) TRANSVERSE DEVICE ARRAY RADIATOR ESA

(75) Inventors: Ralston S. Robertson, Northridge, CA (US); William H. Henderson, Redondo Beach, CA (US); Robert T. Lewis, Vista, CA (US); Romulo J. Broas, Carson, CA (US)

(73) Assignee: Raytheon Company, Waltham, MA (US)

( * ) Notice: Subject to any disclaimer, the term of this patent is extended or adjusted under 35 U.S.C. 154(b) by 12 days.

(21) Appl. No.: 11/016,650

(22) Filed: Dec. 20, 2004

(65) Prior Publication Data

US 2006/0132369 A1 Jun. 22, 2006

(51) Int. Cl.
*H01Q 13/00* (2006.01)
*H01Q 19/06* (2006.01)

(52) U.S. Cl. ..... 343/778; 343/772; 343/754

(58) Field of Classification Search ..... 343/754, 343/767, 772, 778, 783, 785
See application file for complete search history.

(56) References Cited

U.S. PATENT DOCUMENTS

| | | | | |
|---|---|---|---|---|
| 4,447,815 | A | 5/1984 | Chekroun et al. | |
| 4,970,522 | A | 11/1990 | Niman | |
| 5,266,961 | A | 11/1993 | Milroy | |
| 5,412,394 | A | 5/1995 | Milroy | |
| 5,483,248 | A | 1/1996 | Milroy | |
| 5,598,172 | A | 1/1997 | Chekroun | |
| 6,064,349 | A | 5/2000 | Robertson | |
| 6,421,021 | B1 * | 7/2002 | Rupp et al. | 343/753 |
| 6,677,899 | B1 * | 1/2004 | Lee et al. | 342/376 |
| 6,822,615 | B1 * | 11/2004 | Quan et al. | 343/754 |
| 6,999,040 | B1 * | 2/2006 | Robertson et al. | 343/772 |

FOREIGN PATENT DOCUMENTS

| | | |
|---|---|---|
| EP | 0 936 695 A1 | 8/1999 |
| WO | WO 99/00869 | 1/1999 |
| WO | WO 2004/077607 A2 | 9/2004 |

OTHER PUBLICATIONS

Limin Huang, et al., "An Electronically Switchable Leaky Wave Antenna", IEEE Transactions on Antennas and Propagation, vol. 48, No. 11, Nov. 1, 2000, pp. 1769-1772.
Ruey-Shi Chu, "Analysis of Continuous Transverse Stub (CTS) Array by Floquet Mode Method", Antennas and . . . Symposium 1998, vol. 2, Jun. 21, 1998, pp. 1012-1015.
T.W. Bradley, et al., Development of a Voltage-Variable Dielectric (VVD), Electronic Scan Antenna, Radar '97, IEE Conference Pub., vol. 449, Oct. 14, 1997, pp. 383-385.

* cited by examiner

*Primary Examiner*—Shih-Chao Chen
(74) *Attorney, Agent, or Firm*—Leonard A. Alkov; John E. Gunther; Karl A. Vick

(57) ABSTRACT

An antenna array employing continuous transverse stubs as radiating elements is described, which includes an upper conductive plate structure comprising a set of continuous transverse stubs, and a lower conductive plate structure disposed in a spaced relationship relative to the upper plate structure. The upper plate structure and the lower plate structure define an overmoded waveguide medium for propagation of electromagnetic energy. For each of the stubs, one or more transverse device array phase shifters are disposed therein.

25 Claims, 3 Drawing Sheets

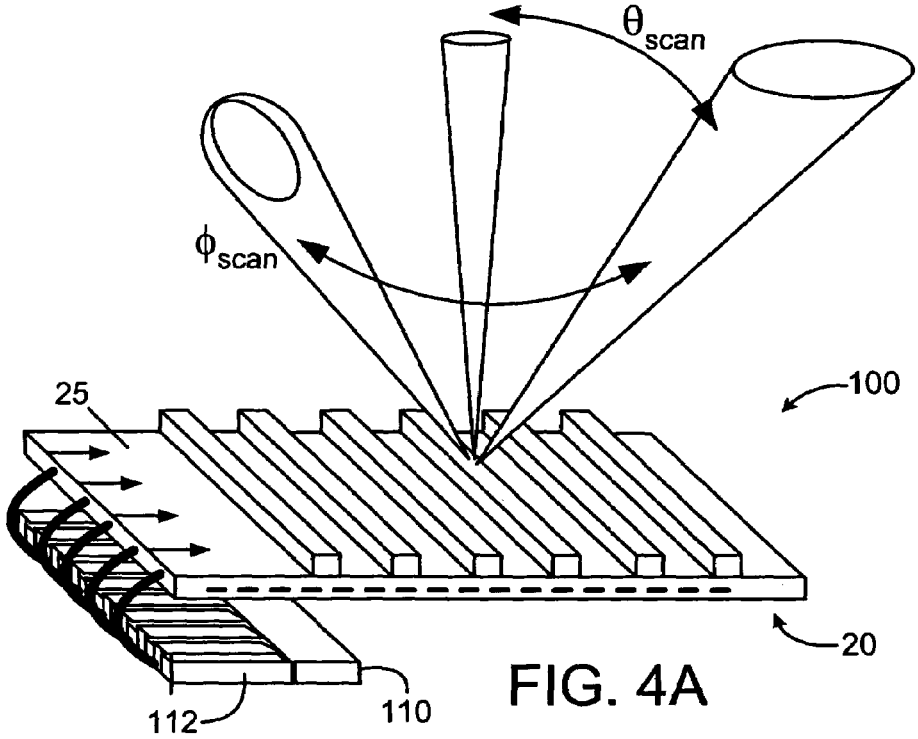
FIG. 4A
FIG. 4B
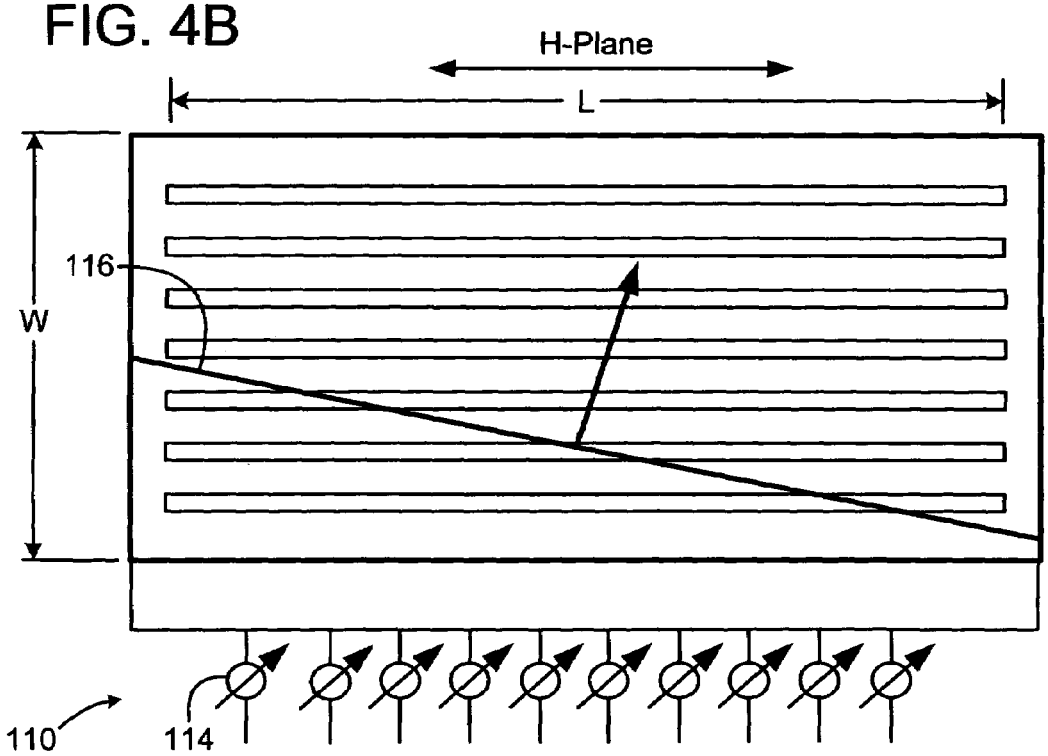

TRANSVERSE DEVICE ARRAY RADIATOR ESA

BACKGROUND OF THE DISCLOSURE

It would be advantageous to provide an electronically scanned antenna (ESA) for applications that could not afford the cost and complexity of either a Transmit/Receive (T/R) module based active array or a ferrite-based phased array to achieve electronic beam scanning.

Electronic scanning of a radiation beam pattern is generally achieved with Transmit/Receive (T/R) module based active arrays or ferrite-based phased arrays The former can employ a T/R module at each radiator of the ESA. The T/R module may employ monolithic microwave integrated circuits (MMICs) to provide signal amplification and a multi-bit phase shifter to scan the radiation beam pattern. The latter employs passive ferrite phase shifters at each radiator to affect beam scan. Both techniques employ expensive components, expensive and complicated feeds and are difficult to assemble. Additionally, the bias electronics and associated beam steering computer are complex. Furthermore, ferrite phase shifter phased arrays are non-reciprocal antenna systems, i.e., transmit and receive antenna patterns are not the same. Ferrites are anisotropic, i.e., the phase shift of the energy in one direction is not replicated in the reverse direction. Ferrite phase shifter ESAs require large currents and complex bias electronics with customized timing to account for the hysteresis nature of most phase shifters.

Other methods to achieve beam steering are the PIN diode based Rotman lens and the voltage variable dielectric lens, employing barium strontium titanate (BST); a voltage variable dielectric material system. Both have either high current or high voltage (10 K volts) biasing requirements, as well as, high insertion loss, hence the radiation efficiency is poor.

SUMMARY OF THE DISCLOSURE

An antenna array employing continuous transverse stubs as radiating elements includes an upper conductive plate structure comprising a set of continuous transverse stubs each defining a stub radiator. A lower conductive plate structure is disposed in a spaced relationship relative to the upper plate structure, the side wall plate structure defining an overmoded waveguide medium for propagation of electromagnetic energy. For each of said stubs, one or more transverse device array (TDA) phase shifters are disposed therein.

BRIEF DESCRIPTION OF THE DRAWINGS

Features and advantages of the disclosure will readily be appreciated by persons skilled in the art from the following detailed description when read in conjunction with the drawing wherein:

FIG. 4A illustrates exemplary embodiments of a two-dimensional TDA Radiator ESA implementation. FIG. 4A depicts an exemplary embodiment of a T/R module line array integrated with a TDA ESA. FIG. 4B illustrates an array of phase shifters to feed the TDA ESA

DETAILED DESCRIPTION OF THE DISCLOSURE

Figure 1:
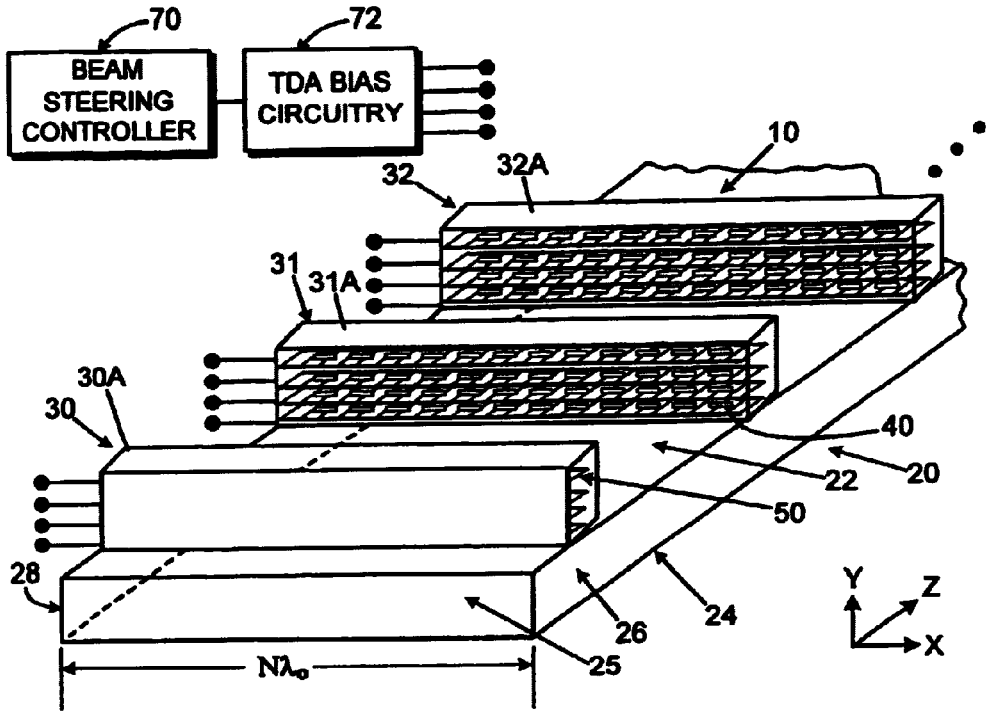
FIG. 1 diagrammatically illustrates an exemplary embodiment of an electronically scanned antenna employing transverse diode array phase shifters and called the TDA Radiator ESA.

In the following detailed description and in the several figures of the drawing, like elements are identified with like reference numerals.

An antenna array employing continuous transverse stubs as radiating elements is described, which includes an upper conductive plate structure comprising a set of continuous transverse stubs, and a lower conductive plate structure disposed in a spaced relationship relative to the upper plate structure. The upper plate structure and the lower plate structure define an overmoded waveguide medium for propagation of electromagnetic energy. Continuous slots are cut into the top wall of the waveguide and act as waveguide couplers to couple energy in a prescribed manner into the stub radiators.

For each of the stub radiators, one or more transverse device (TDA) array phase shifters are disposed therein. Each TDA circuit comprises a generally planar dielectric substrate having a microwave circuit defined thereon, and a plurality of spaced discrete voltage variable capacitance elements, e.g. semiconductor junction devices or voltage variable (BST) capacitors. The substrate is disposed within the waveguide structure generally transverse to the side wall surfaces of the radiator element. A bias circuit applies a voltage to reverse bias the semiconductor junctions. The transverse device array phase shifter circuit under reverse bias causes a change in phase of microwave or millimeter-wave energy propagating through the waveguide radiator structure. The subsequent phase shift acts to scan the beam along the length of the antenna. In a two-dimensional application, the incorporation of a line array of either T/R modules or phase shifters enables the launch of a dominant mode with a canted wave front across the radiator/stub.

An exemplary embodiment of an electronically scanned antenna 10 is diagrammatically illustrated in FIG. 1. The antenna may be considered a type of a Continuous Transverse Stub (CTS) antenna. A CTS antenna is described in U.S. Pat. No. 5,483,248.

The antenna 10 includes a parallel plate structure 20 comprising a top conductive plate 22, a bottom conductive plate 24 and opposed side conductive plates 26, 28. The width of the side plate structures (26 and 28) is selected to provide an overmoded waveguide structure. In this exemplary embodiment, the waveguide structure has a broad wall dimension selected to be N times the wavelength ($\lambda_0$) of the center frequency of operation of the array.

In an overmoded waveguide structure, the cross section is significantly larger than conventional, single mode rectangular waveguide. Overmoded waveguide is defined as a waveguide medium whose height and width are chosen so that electromagnetic modes other than the principal dominant $TE_{10}$ mode can carry electromagnetic energy. As an example, a conventional single mode, X-band rectangular waveguide, which operates at or near 10 GHz, has cross sectional dimensions of 0.900 inches wide by 0.400" high; (0.90"×0.40"). An exemplary embodiment of an overmoded waveguide structure suitable for the purpose has a cross section of 9.00 inches wide by 0.150" high (9.00"×0.15"). For this embodiment, the waveguide structure width can support several higher order modes. The height for this embodiment is selected based upon elimination of higher order modes that can be supported and propagated in the "y"

dimension of the coordinate system of FIG. 1. Other waveguide dimensions can be used.

The upper plate 22 has extending from the plate surface a set of equally spaced, CTS radiating elements 30, 31, 32, . . . . CTS radiators are well known in the art, e.g. U.S. Pat. Nos. 5,349,363 and 5,266,961. Note that three stub radiators 30 are shown as an example, although the upper plate 22 may have more stubs, or less stubs. The sides of each stub are a metal surface, as illustrated in stub 30 and act to encapsulate the transverse device arrays (TDAs) 50 within the stubs. The top edge surface 30A, 31A and 32A of each stub has no conductive shielding, thus allowing electromagnetic energy propagation through this surface and establishing the antenna radiation pattern.

In an exemplary embodiment, the entire waveguide media is filled with any homogenous and isotropic dielectric material. For example, the media can be filled with a low loss plastic like Rexolite®, Teflon®, glass filled Teflon like Duroid® or may also be air-filled. A combination of air media, circuit boards and waveguide dielectric may in an exemplary embodiment be employed in the construction of the radiating stubs. Furthermore, although the ESA in FIG. 1 is depicted with the stubs rising above the top surface of the antenna, the top surface of the antenna may be designed to be coplanar with the surface of the radiator. In an exemplary embodiment, Z-traveling waveguide modes are launched into the waveguide structure at end 25 via a line feed (not shown) of arbitrary configuration. The dominant waveguide mode can be constructed to emulate a Transverse Electromagnetic Mode (TEM) for one such embodiment.

Figure 2:
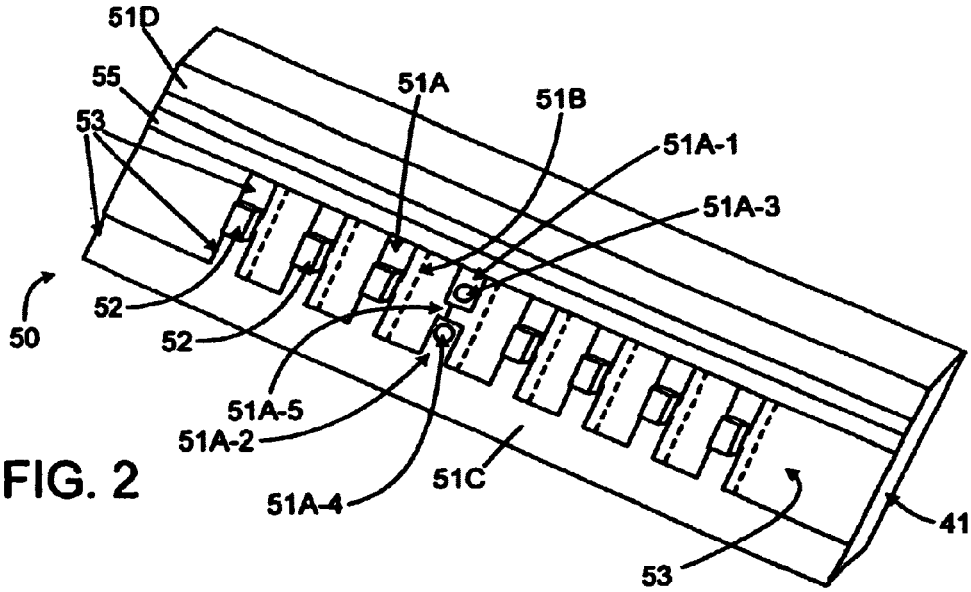
FIG. 2 diagrammatically illustrates a Transverse Device Array Phase Shifter depicted in FIG. 1.

In an exemplary embodiment, the stub radiators 30 are active elements containing cascaded, Transverse Device Array (TDA) phase shifters, 50, which in this embodiment employ varactor diodes 52. FIG. 2 illustrates an exemplary one of the TDA circuits 50. In exemplary embodiments, the TDA phase shifters are discrete diode phase shifters that employ discrete semiconductor diodes (varactors or Schottkys or voltage variable capacitors) as the phase shifting element. The diodes are mounted on a dielectric substrate 41 of any convenient material, e.g. a glass loaded Teflon™ material, quartz, Duroid™, etc. The dielectric board, which is plated on both sides with a metal, e.g. copper, is patterned on both sides and then etched to realize microwave circuits arrayed in a picket fence-like configuration with an array of metal contacts for the devices/diodes, to form an array 53. The varactor/Schottky diodes of the TDA are bonded at each circuit junction to affect electrical contact.

FIG. 2 is a simplified illustration of TDA circuit 50, showing the microwave circuit conductors 51A, 51B on both sides of the board in this embodiment. One diode is omitted from one set of conductors to illustrate the junction or opening 51A-5 between conductor portions 51A-1 and 51A-2 and the metal contacts 51A-3 and 51A-4 to which the diode is bonded. It will be seen that the microwave pattern 53 includes the generally vertically oriented circuit conductors 51A, 51B, a transversely oriented ground conductor strip 51C adjacent the bottom wall of the waveguide, and a transversely oriented conductor strip 51D adjacent the top wall of the rectangular waveguide. The conductor forming the strips 51C and 51D can be wrapped around the bottom and top edges of the substrate board 41. The metal layer pattern also defines a common bias conductor line 55 connected to each conductor 51A along, but spaced from, the conductor strip 51D adjacent top wall of the waveguide structure. The line 55 is connected to a DC bias circuit 72 (FIG. 1) controlled by a beam steering controller 70 (FIG. 1) for applying a reverse bias to the devices 52.

Figure 3:
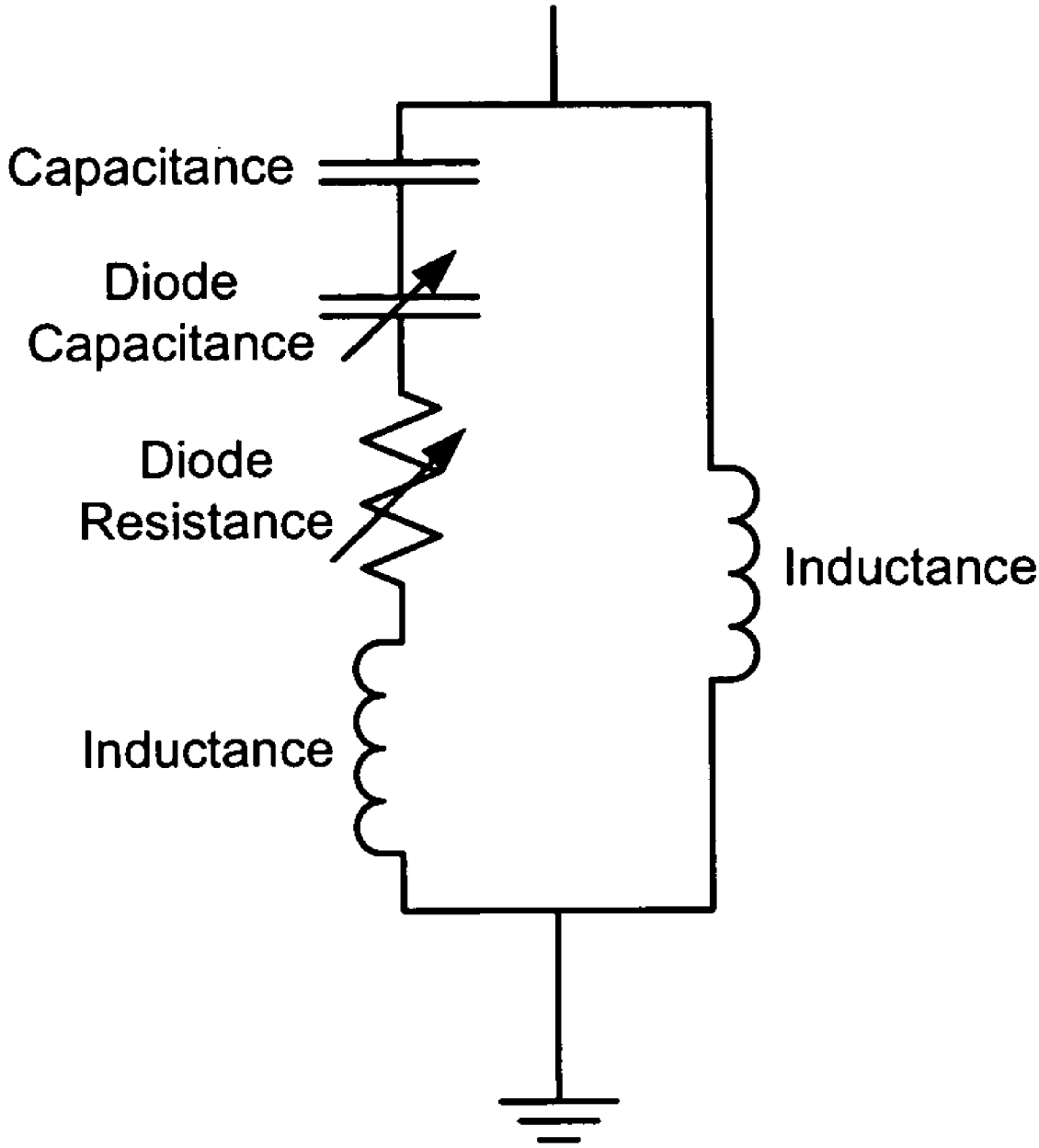
FIG. 3 represents an exemplary equivalent circuit model of the Transverse Device Array.

FIG. 3 represents an exemplary equivalent circuit model of the Transverse Device Array. Since the TDA interacts with the propagating electromagnetic mode, the equivalent circuit is an attempt to approximate the distributed electromagnetic phenomenology with an equivalent discrete element circuit model. As an example, when the varactor diode is employed as the tuning element, the variable capacitor represents the voltage variable change in the diode depletion region of the diode junction thereby providing the voltage variable capacitance change of the varactor. The variable resistor is the change in the undepleted epitaxial resistance of the diode with applied voltage. The capacitance above the diode equivalent circuit arises from the gap in the metallizations 55 and 51D of FIG. 2, namely metal/dielectric/metal configuration. The inductor element represents the metal strips which connect the diode to the rest of the printed circuit. Other elements of the circuit like the inductor are realized by the final printed circuit topography of the of the TDA circuit. The final circuit metallization pattern, both on the front-side and the back-side of the board, is varied to provide in a distributed manner the appropriate equivalent circuit performance to establish such performance parameters as the return loss, optimize the insertion loss and set the center frequency of the TDA phase shifter.

Referring again to FIG. 1, on transmit, the energy is launched at one end 25 of the potentially overmoded waveguide. The continuous slots 40 in the top of the waveguide act as coupler networks which couple a portion of the incident energy in a prescribed manner into the radiating stubs, 30, 31 and 32. This energy encounters the TDAs depicted in FIG. 2. The diodes provide a voltage variable capacitance, which in one exemplary embodiment may be greater than or equal to a 4:1 variation over the reverse bias range of the diode. This voltage variable reactance is the source of the phase shifting phenomenology. The spacing of the devices (52) on a given substrate in an exemplary embodiment may be based upon a minimization of reflected energy at the center frequency of operation, i.e., realization of a RF matched impedance condition and the control of higher order waveguide modes. In one exemplary embodiment, the devices 52 are equally spaced on the board. The diode spacing, relative to each other, is determined during the electromagnetic simulation and design process. In one exemplary embodiment, an element spacing may be selected that insures that the higher order waveguide modes, which are generated when the electromagnetic wave strikes the transverse device array, rapidly attenuate or evanesce away from the array. This evanescent property insures that mutual coupling of the fields of these higher order modes does not occur between successive Transverse Device Arrays. A starting separation distance between TDA boards in an exemplary embodiment would be a quarter of a guide wavelength ($\lambda_g/4$) and then the final separation may be determined via an iterative finite element simulation process. The analytical process may conclude when the desired performance is achieved for the phase shifter.

Several diode arrays 50 are cascaded in each stub, as illustrated in FIG. 1, within the potentially overmoded waveguide cross section of the radiating element. This exemplary embodiment of the phase shifter, unlike some phase shifter architectures, is an "analog" implementation. Each bias voltage for the device corresponds to one value of capacitance in a continuous, albeit, nonlinear capacitance versus voltage relationship. Hence, the transverse device array phase shifter enables a continuous variation in phase shift with bias voltage. The radiating element is rendered active via the TDA Bias Circuitry 72 depicted in FIG. 1 and a phase variation of 360 degrees is now possible and practical for an exemplary embodiment.

The overmoded waveguide medium of the CTS antenna employs broad wall slots 40 in the top wall of the waveguide to divide the input power to the antenna in a manner appropriate to establishing the antenna aperture distribution and the far field radiation beam pattern; a well known feature of the CTS antenna architecture. The space within each stub is also dimensioned to be overmoded, and is identical in width to the input waveguide feed in an exemplary embodiment as depicted in FIG. 1. The architecture dramatically reduces the power into each radiator, i.e. each stub, as compared to the power incident to the waveguide input cross section. This feature enables a substantial reduction in the power handling requirement for the varactor diodes of the TDA Phase Shifter arrays. The TDAs disposed in each slot are now in a parallel configuration with the TDAs disposed in the other slots. Additionally, the overall antenna efficiency is improved since the loss associated with the TDA elements are also in a parallel configuration to the main waveguide input. Finally, the 360 degrees of active phase control available in the radiator results in a substantial 1-dimensional (1-D) scan volume from backfire (−90 degrees) to endfire (+90 degrees). The result is a highly efficient, one-dimensional, electronically scanned antenna (ESA).

Since in an exemplary embodiment, the entire waveguide media is filled with a homogenous and isotropic dielectric material and the TDAs are bilateral, the ESA is reciprocal, i.e. both transmit and receive beams are identical. Since the diodes are operated reverse biased, the current required to bias the phase shifter is negligible; typically nanoamperes. The subsequent power draw is negligible and consequently the beam steering computer and bias electronics are trivial. The result is a one-dimensional (1-D) active phased array, which employs no T/R modules in an exemplary embodiment.

In an exemplary embodiment, an integration of the CTS-like architecture and the TDA Phase Shifter technology enables the realization of an ESA which provides radiation efficiency, reciprocal electronic beam scan and a low cost implementation methodology in an extremely simple manner. It is applicable at both microwave and millimeter-wave frequencies. The TDA Radiator ESA may in exemplary embodiments employ simple and low cost manufacturing materials and methods to implement the ESA. Both the phase shifter and the antenna are architecturally simple. The antenna beam can be scanned with a bias voltage of typically less than 20 volts in an exemplary embodiment. Since the diodes are reverse-biased, the bias current may be in the nanoampere range in an exemplary embodiment; hence the bias electronics and beam steering computer may be simple to implement. The low bias voltage and current can make beam steering available with response times of substantially less than 10 nanoseconds in one exemplary embodiment. Additional, beam steering can be realized by cascading more TDA elements, of at least 360 degrees, within each radiating element of the array. The phase shifters are now in parallel to the dominant feed of the antenna. Hence, in an exemplary embodiment, the antenna loss may be dominated by the parallel element rather than a series element, which would result with the TDA elements within the main waveguide structure.

FIGS. 4A and 4B illustrate alternate embodiments of a TDA ESA 100 capable of two-dimensional scanning. The antenna 100 includes a parallel plate structure 20 as with the embodiment of FIG. 1, with TDAs incorporated in the radiating stubs as in the one-dimensional embodiment, not shown in FIGS. 4A–4B for clarity. The array is controlled by a beam steering computer and TDA bias circuitry (not shown in FIGS. 4A–4B) as with the embodiment of FIGS. 1–3. The ESA 100 includes a line array 110 of either T/R modules 112 (FIG. 4A) or phase shifters 114 (FIG. 4B) to feed the TDA ESA, controlled by the beam steering controller. The incorporation of a line array 110 of either T/R modules which include a monolithic microwave integrated circuit phase shifter element, or phase shifters enables the launch of a dominant mode with a canted wave front 116 (FIG. 4B) across the radiator/stub. FIG. 4A depicts an exemplary embodiment of a T/R module line array integrated with a TDA Radiator ESA. The canted wave front, illustrated in FIG. 4B, a top view of the antenna, acts to scan the antenna beam across the width of the array. The result is a two dimensional scan. Some coupling does exist between the two scan mechanisms, but to first order the TDA radiators enable the scan down the length of the array and the T/R module or phase shifter line array enables the scan across the array. Simultaneous control of the two scan mechanisms provides 2-dimensional space location of the beam in both the theta ($\theta$) angle location and the phi ($\phi$) angle location of a conventional spherical coordinate system.

Exemplary frequency bands of different embodiments of the TDA Radiator ESA include Ku-band, X-band and Ka-band.

Since the phase shifters are cascaded in the radiator in an exemplary embodiment, 360 degrees of phase control can be available for each radiator and provides large scan volumes. This electronically scanned antenna, with its potential large scan volume in an exemplary embodiment, makes possible commercial communication applications, heretofore, unavailable due to cost considerations of available technology.

Although the foregoing has been a description and illustration of specific embodiments of the invention, various modifications and changes thereto can be made by persons skilled in the art without departing from the scope and spirit of the invention as defined by the following claims.

What is claimed is:

1. An antenna array employing continuous transverse stubs as radiating elements, comprising:

an upper conductive plate structure comprising a set of continuous transverse stubs each defining a stub radiator;

a lower conductive plate structure disposed in a spaced relationship relative to the upper plate structure;

a side wall plate structure defining with the upper conductive plate structure and the lower conductive plate structure an overmoded waveguide medium for propagation of electromagnetic energy;

for each of said stubs, one or more transverse device array (TDA) phase shifters disposed therein.

2. The may of claim 1, wherein said one or more TDA phase shifters includes a plurality of cascaded TDA phase shifters.

3. The array of claim 1, wherein said one or more TDA phase shifters each comprises a generally planar dielectric substrate having a circuit defined thereon, the circuit including a plurality of spaced discrete semiconductor diode elements each having a voltage variable reactance, the substrate disposed within the stub radiator generally transverse to side wall surfaces of the stub radiator; and a bias circuit for applying a reverse bias voltage to effect the voltage variable reactance;

the TDA phase shifter under reverse bias causing a change in phase of microwave or millimeter wave energy propagating through the stub radiator.

4. The array of claim 3, wherein said one or more TDA phase shifters includes a plurality of cascaded phase shifters in spaced relation within the stub radiator.

5. The array of claim 3, wherein each TDA phase shifter circuit comprises a dielectric substrate, and wherein the substrates of each of said plurality of phase shifters are arranged in a parallel arrangement.

6. The array of claim 1, wherein the overmoded waveguide medium is filled with a homogenous and isotropic dielectric material.

7. The array of claim 1, wherein the side wall plate structure has a broad wall dimension selected to be "N" times a wavelength of a center frequency of operation of the array.

8. The array of claim 1, wherein the transverse device array phase shifters include discrete semiconductor diodes.

9. The array of claim 8, wherein the discrete semiconductor devices comprise varactor diodes or Schottky diodes or voltage variable capacitors.

10. The array of claim 1, further comprising an array of transmit/receive modules or phase shifters to launch an input wave with a canted wave front.

11. A one dimensional continuous transverse stub electronically scanned array, comprising:

an overmoded waveguide structure having a top conductive broad wall surface comprising a set of continuous transverse stubs, a bottom conductive broad wall surface, and opposed first and second conductive side wall surfaces;

at least one transverse device array circuit disposed in each stub, each circuit comprising a generally planar dielectric substrate having a microwave circuit defined thereon, and a plurality of spaced discrete semiconductor device elements each having a semiconductor junction, the substrate disposed within the stub generally transverse to the side wall surfaces; and a bias circuit for applying a reverse bias voltage to reverse bias the semiconductor junctions;

the at least one transverse device array circuit under reverse bias causing a change in phase of microwave or millimeter wave energy propagating through the stubs to scan a beam in one dimension.

12. The array of claim 11, wherein the semiconductor elements each comprise a varactor diode structure.

13. The array of claim 11, wherein the at least one transverse device array circuit comprises a plurality of spaced transverse device array circuits disposed in the stub, each circuit comprising a substrate, and wherein the substrates of the plurality of spaced transverse array circuits are disposed in a cascaded configuration.

14. The phase shifter of claim 11 further comprising a dielectric fill material disposed in said waveguide structure.

15. An antenna array employing continuous transverse stubs as radiating elements, comprising:

an upper conductive plate structure comprising a set of continuous transverse stubs each defining a stub radiator;

a lower conductive plate structure disposed in a spaced relationship relative to the upper plate structure;

a side wail plate structure defining with the upper conductive plate structure and the lower conductive plate structure an overmoded waveguide medium for propagation of electromagnetic energy;

for each of said stubs, one or more transverse device array (TDA) phase shifters disposed therein; and means for launching an input wave with a canted wave front into the waveguide medium.

16. The array of claim 15, wherein said one or more TDA phase shifters includes a plurality of cascaded TDA phase shifters.

17. The array of claim 15, wherein said one or more TDA phase shifters each comprises a dielectric substrate having a circuit defined thereon, the circuit including a plurality of spaced discrete semiconductor diode elements each having a voltage variable reactance, the substrate disposed within the stub radiator generally transverse to side wall surfaces of the stub radiator; and a bias circuit for applying a reverse bias voltage to effect the voltage variable reactance;

said one or more TDA phase shifters under reverse bias causing a change in phase of microwave or millimeter wave energy propagating through the stub radiator.

18. The array of claim 17, wherein said one or more TDA phase shifters includes a plurality of cascaded phase shifters in spaced relation with the stub radiator.

19. The array of claim 17, wherein each TDA phase shifter circuit comprises a dielectric substrate, and wherein the substrates of each of said plurality of phase shifters are arranged in a parallel arrangement.

20. The array of claim 15, wherein the overmoded waveguide medium is filled with a homogenous and isotropic dielectric material.

21. The array of claim 15, wherein the side wall plate structure has a broad wall dimension selected to be "N" times a wavelength of a center frequency of operation of the array.

22. The array of claim 15, wherein the transverse device array phase shifters include discrete semiconductor diodes.

23. The array of claim 22, wherein the discrete semiconductor diodes comprise varactor diodes or Schottky diodes or voltage variable capacitors.

24. The array of claim 17, further comprising a beam steering controller for controlling said means for launching and said bias circuit for scanning the beam in two dimensions.

25. The array of claim 15, wherein said means for launching an input wave comprises an array of transmit/receive modules or phase shifters to launch said input wave.

* * * * *